US005954154A

United States Patent [19]

Ziolkowski

[11] Patent Number: 5,954,154

[45] Date of Patent: Sep. 21, 1999

[54] LADDER WITH BOTTOM STEP INDICATOR

[76] Inventor: Robert L. Ziolkowski, 7740 Glen Ave., Pasadena, Md. 21122

[21] Appl. No.: 09/078,700

[22] Filed: May 14, 1998

[51] Int. Cl.[6] ..... E06C 5/44

[52] U.S. Cl. ..... 182/129; 182/18

[58] Field of Search ..... 182/129, 18

[56] References Cited

U.S. PATENT DOCUMENTS 4,311,208 1/1982 Macrorie ..... 182/18

FOREIGN PATENT DOCUMENTS 1178104 9/1964 Germany ..... 182/18

*Primary Examiner*—Alvin Chin-Shue

[57] ABSTRACT

A new ladder with bottom step indicator for indicating to a user when the bottom step of the ladder has been stepped on. The inventive device includes a pair of spaced apart elongate rails each having upper and lower ends with a plurality of steps extending between the rails. A light source is attached to one of the steps and a switch is provided on another of the steps and is electrically coupled to the light source such that a user stepping on this step activates the light source.

13 Claims, 2 Drawing Sheets

LADDER WITH BOTTOM STEP INDICATOR

BACKGROUND OF THE INVENTION

1. Field of the Invention

The present invention relates to ladder devices and more particularly pertains to a new ladder with bottom step indicator for indicating to a user when the bottom step of the ladder has been stepped on.

2. Description of the Prior Art

The use of ladder devices is known in the prior art. More specifically, ladder devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art ladder devices include U. S. Pat. No. 4,311,208; U.S. Pat. No. 5,210,528; U.S. Pat. No. Des. 342,913; U.S. Pat. No. 4,766,525; U.S. Pat. No. 4,367,517; and U.S. Pat. No. 4,554,994.

While these devices fulfill their respective, particular objectives and requirements, the aforementioned patents do not disclose a new ladder with bottom step indicator. The inventive device includes a pair of spaced apart elongate rails each having upper and lower ends with a plurality of steps extending between the rails. A light source is attached to one of the steps and a switch is provided on another of the steps and is electrically coupled to the light source such that a user stepping on this step activates the light source.

In these respects, the ladder with bottom step indicator according to the present invention substantially departs from the conventional concepts and designs of the prior art, and in so doing provides an apparatus primarily developed for the purpose of indicating to a user when the bottom step of the ladder has been stepped on.

SUMMARY OF THE INVENTION

In view of the foregoing disadvantages inherent in the known types of ladder devices now present in the prior art, the present invention provides a new ladder with bottom step indicator construction wherein the same can be utilized for indicating to a user when the bottom step of the ladder has been stepped on.

The general purpose of the present invention, which will be described subsequently in greater detail, is to provide a new ladder with bottom step indicator apparatus and method which has many of the advantages of the ladder devices mentioned heretofore and many novel features that result in a new ladder with bottom step indicator which is not anticipated, rendered obvious, suggested, or even implied by any of the prior art ladder devices, either alone or in any combination thereof.

To attain this, the present invention generally comprises a pair of spaced apart elongate rails each having upper and lower ends with a plurality of steps extending between the rails. A light source is attached to one of the steps and a switch is provided on another of the steps and is electrically coupled to the light source such that a user stepping on this step activates the light source.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new ladder with bottom step indicator apparatus and method which has many of the advantages of the ladder devices mentioned heretofore and many novel features that result in a new ladder with bottom step indicator which is not anticipated, rendered obvious, suggested, or even implied by any of the prior art ladder devices, either alone or in any combination thereof.

It is another object of the present invention to provide a new ladder with bottom step indicator which may be easily and efficiently manufactured and marketed.

It is a further object of the present invention to provide a new ladder with bottom step indicator which is of a durable and reliable construction.

An even further object of the present invention is to provide a new ladder with bottom step indicator which is susceptible of a low cost of manufacture with regard to both materials and labor, and which accordingly is then susceptible of low prices of sale to the consuming public, thereby making such ladder with bottom step indicator economically available to the buying public.

Still yet another object of the present invention is to provide a new ladder with bottom step indicator which provides in the apparatuses and methods of the prior art some of the advantages thereof, while simultaneously overcoming some of the disadvantages normally associated therewith.

Still another object of the present invention is to provide a new ladder with bottom step indicator for indicating to a user when the bottom step of the ladder has been stepped on.

Yet another object of the present invention is to provide a new ladder with bottom step indicator which includes a pair of spaced apart elongate rails each having upper and lower ends with a plurality of steps extending between the rails. A light source is attached to one of the steps and a switch is provided on another of the steps and is electrically coupled to the light source such that a user stepping on this step activates the light source.

Still yet another object of the present invention is to provide a new ladder with bottom step indicator that warns a user climbing down a ladder when the last step of the ladder has been reached so that the user knows when it is time to get off of the ladder.

Even still another object of the present invention is to provide a new ladder with bottom step indicator that helps prevent a user from mistakenly missing the bottom step of ladder when descending the ladder.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
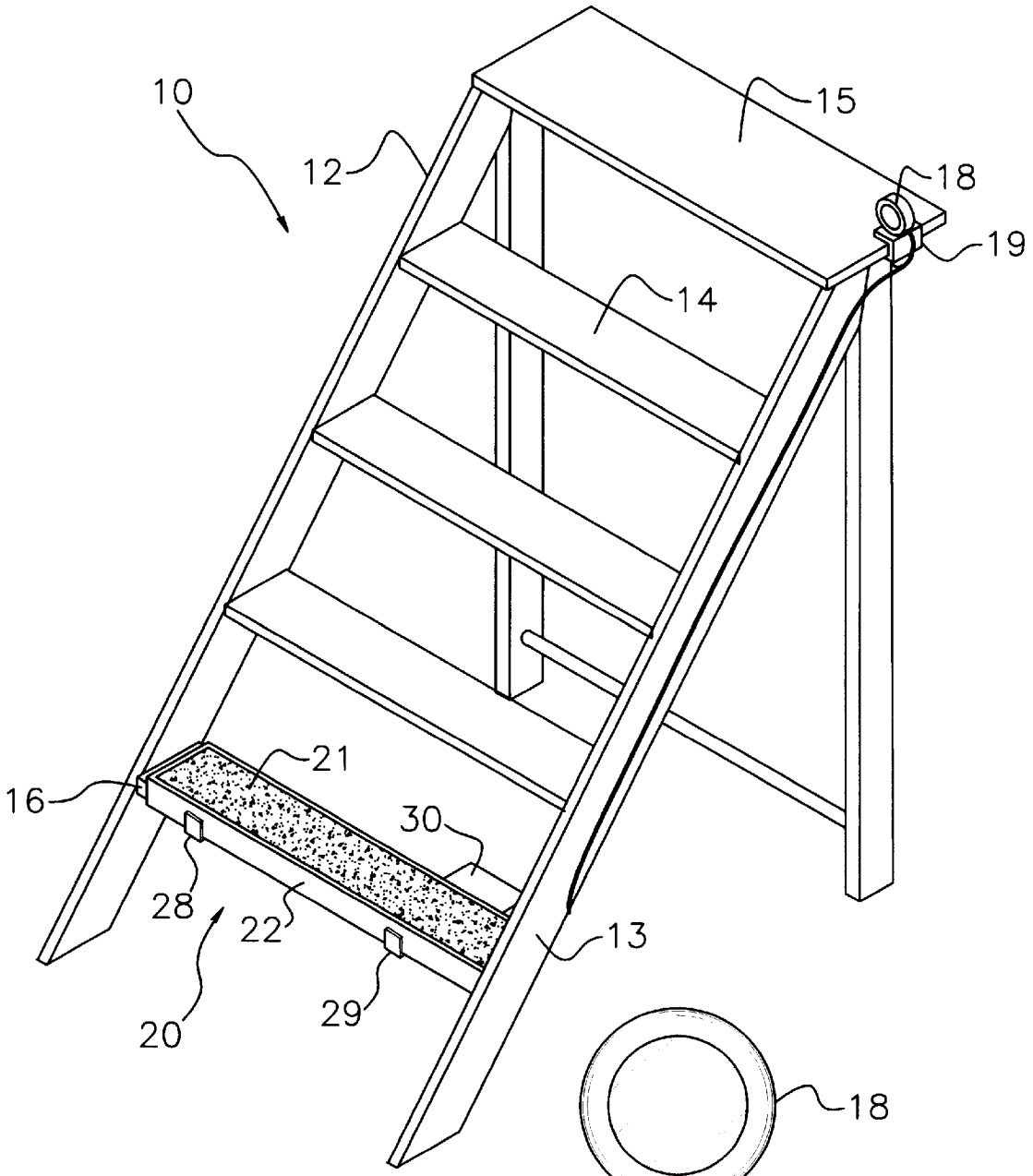
FIG. 1 is a schematic perspective view of a new ladder with bottom step indicator according to the present invention.
Figure 2:
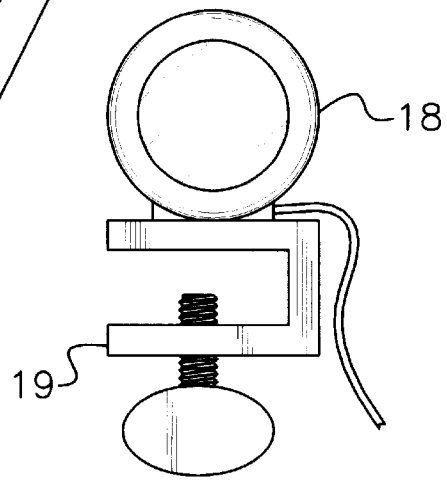
FIG. 2 is a schematic side view of the light source of the present invention.
Figure 3:
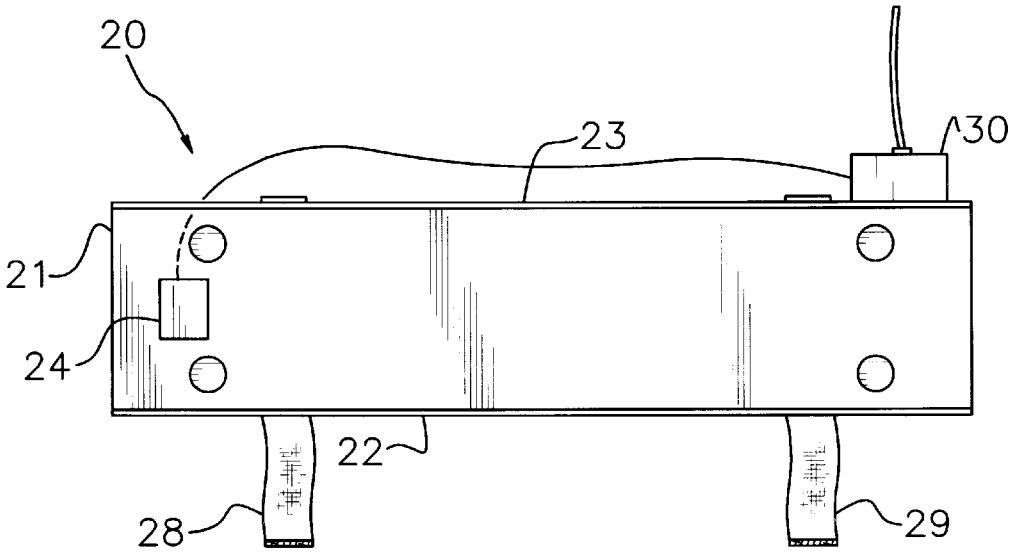
FIG. 3 is a schematic bottom view of the channel of the top plate of the present invention.

With reference now to the drawings, and in particular to FIGS. 1 through 4 thereof, a new ladder with bottom step indicator embodying the principles and concepts of the present invention and generally designated by the reference numeral 10 will be described.

As best illustrated in FIGS. 1 through 4, the ladder with bottom step indicator 10 generally comprises a pair of spaced apart elongate rails 12,13 each having upper and lower ends with a plurality of steps 14 extending between the rails 12,13. A light source 18 is attached to one of the steps and a switch 20 is provided on another of the steps and is electrically coupled to the light source 18 such that a user stepping on this step activates the light source 18.

In closer detail, the ladder 10 includes a pair of spaced apart elongate rails 12,13 each having upper and lower ends with a plurality of steps 14 extending between the rails 12,13. Preferably, the plurality of steps 14 includes a top step 15 located adjacent the upper ends of the rails 12,13 and a bottom step 16 located adjacent the lower ends of the rails 12,13.

The light source 18 is attached to one of the steps 14. Preferably, the light source 18 is detachably attached to the top step 15, ideally, by a mounting clamp 19 with a mounting screw.

Figure 4:
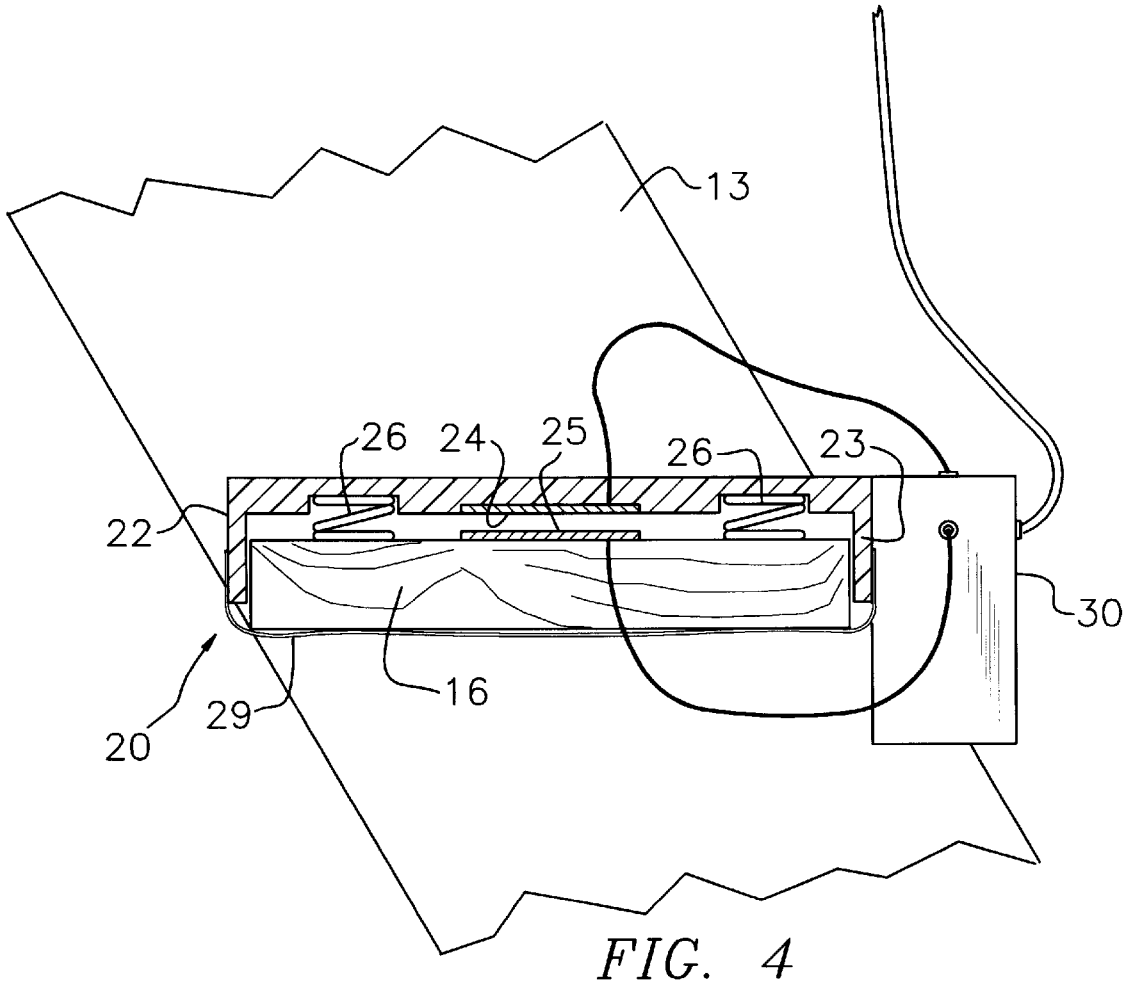
FIG. 4 is a schematic sectional view of the switch of the present invention.

The switch 20 is provided on another of the steps 14, preferably, the bottom step 16. The switch 20 is operatively connected to the light source 18 such that the light source 18 is activated by the switch 20 when a user steps 14 on the other bottom step 16. As best illustrated in FIG. 4, the switch 20 preferably, includes a top plate 21 having a pair of lower skirt walls 22,23 downwardly depending from its sides. The lower skirt walls 22,23 are spaced apart from each other to define a channel between them. The top plate 21 is positioned on the bottom step 16 such that the bottom step 16 is disposed in the channel between the lower skirt walls 22,23. A pair of contact plates 24,25 are provided in the channel between the top plate 21 and the bottom step 16. Preferably, one of the contact plates 24 is coupled to the top plate 21 while the other contact plate 25 is coupled to the bottom step 16. The top plate 21 is biased away from the bottom step 16 such that the contact plates 24,25 are biased away from one another. Preferably, a plurality of springs 26 provided in the channel bias the top plate 21 away from the bottom step 16. Each of the contact plates 24,25 is electrically coupled to the light source 18 such that when the contact plates 24,25 are in contact a circuit is completed to activate the light source 18.

In the preferred embodiment, the ends of a pair of detachable securing straps 28,29 are coupled to each of the lower skirt walls 22,23 and are looped around the bottom step 16. The securing straps 28,29 are designed for holding the top plate 21 to the bottom step 16.

Also provided in the preferred embodiment is a power source 30, ideally a battery, which is electrically coupled to the light source 18 and mounted to the top plate 21.

In use, when a user of the ladder 10 steps on the top plate 21 on the bottom step 16, the contact plates 24,25 are pushed together until they are in contact to complete a circuit with the light source 18 and activate the light source to indicate to the user that he is stepping on the bottom step 16 of the ladder.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A ladder, comprising:

a pair of spaced apart elongate rails each having upper and lower ends;

a plurality of steps being extended between said rails;

a light source being attached to one of said steps;

a switch being provided on another of said steps and being electrically coupled to said light source;

wherein said switch comprises:

a top plate being positioned on said another of said steps;

a pair of contact plates being provided between said top plate and said step, one of said contact plates being coupled to said top plate, another of said contact plates being coupled to said step;

said top plate being biased away from said step such that said contact plates are biased away from one another; and each of said contact plates being electrically coupled to said light source.

2. The ladder of claim 1, wherein said plurality of steps includes a top step being located adjacent said upper ends of said rails, said plurality of steps including a bottom step being located adjacent said lower ends of said rails, wherein said light source is detachably attached to said top step, and wherein said switch is provided on said bottom step.

3. The ladder of claim 1, wherein a mounting clamp attaches said light source to said one step.

4. The ladder of claim 1, wherein a plurality of springs are provided between said top plate and said step to bias said top plate away from said step.

5. The ladder of claim 1, further comprising a power source being electrically coupled to said light source.

6. A ladder, comprising:

a pair of spaced apart elongate rails each having upper and lower ends;

a plurality of steps being extended between said rails;

a light source being attached to one of said steps;

a switch being provided on another of said steps and being electrically coupled to said light source;

wherein said switch comprises:

a top plate having a pair of lower skirt walls being downwardly depended therefrom, said lower skirt walls being spaced apart to defining a channel therebetween, said top plate being positioned on said another of said steps such that said step is disposed in said channel between said lower skirt walls;

a pair of contact plates being provided in said channel between said top plate and said step, one of said contact plates being coupled to said top plate, another of said contact plates being coupled to said step;

said top plate being biased away from said bottom step such that said contact plates are biased away from one another; and each of said contact plates being electrically coupled to said light source.

7. The ladder of claim 6, wherein a plurality of springs are provided in said channel to bias said top plate away from said step.

8. The ladder of claim 6, further comprising a pair of securing straps being coupled to each of said lower skirt walls and being looped around said step.

9. The ladder of claim 6, further comprising a power source being electrically coupled to said light source.

10. The ladder of claim 6, wherein said plurality of steps includes a top step being located adjacent said upper ends of said rails, said plurality of steps including a bottom step being located adjacent said lower ends of said rails, wherein said light source is detachably attached to said top step, and wherein said switch is provided on said bottom step.

11. The ladder of claim 6, wherein a mounting clamp attaches said light source to said one step.

12. A ladder, comprising:

a pair of spaced apart elongate rails each having upper and lower ends;

a plurality of steps being extended between said rails, said plurality of steps including a top step being located adjacent said upper ends of said rails, said plurality of steps including a bottom step being located adjacent said lower ends of said rails;

a light source being detachably attached to one of said steps, wherein said light source is detachably attached to said top step, wherein a mounting clamp attaches said light source to said top step;

a switch being provided on another of said steps, wherein said switch is provided on said bottom step, said switch being operatively connected to said light source such that said light source is activated by said switch when a user steps on said bottom step;

wherein said switch comprises:

a top plate having a pair of lower skirt walls being downwardly depended therefrom, said lower skirt walls being spaced apart to defining a channel therebetween, said top plate being positioned on said bottom step such that said bottom step is disposed in said channel between said lower skirt walls;

a pair of contact plates being provided in said channel between said top plate and said bottom step, one of said contact plates being coupled to said top plate, another of said contact plates being coupled to said bottom step;

said top plate being biased away from said bottom step such that said contact plates are biased away from one another, wherein a plurality of springs provided in said channel bias said top plate away from said bottom step;

each of said contact plates being electrically coupled to said light source;

a pair of securing straps being coupled to each of said lower skirt walls and being looped around said bottom step; and a power source being electrically coupled to said light source.

13. The ladder of claim 12, wherein said power source comprises a battery coupled to said top plate.

* * * * *